US005592442A

United States Patent [19]

Nishikawa et al.

[11] Patent Number: 5,592,442

[45] Date of Patent: Jan. 7, 1997

[54] WATCH HAVING A SENSOR

[75] Inventors: Junichi Nishikawa; Tomomi Murakami; Nobuyuki Uehara, all of Tanashi, Japan

[73] Assignee: Citizen Watch Co., Ltd., Japan

[21] Appl. No.: 422,595

[22] Filed: Apr. 14, 1995

[30] Foreign Application Priority Data

| | | | |
|---|---|---|---|
| Apr. 14, 1994 | [JP] | Japan | 6-075961 |
| May 20, 1994 | [JP] | Japan | 6-106898 |
| May 31, 1994 | [JP] | Japan | 6-118606 |
| Apr. 11, 1995 | [JP] | Japan | 7-085164 |

[51] Int. Cl.[6] ..... G04B 47/06

[52] U.S. Cl. ..... 368/11; 73/754

[58] Field of Search ..... 368/10, 11, 73, 368/71; 73/754, 291, 384, 386, 437, 753

[56] References Cited

U.S. PATENT DOCUMENTS

| | | | |
|---|---|---|---|
| 4,352,168 | 9/1982 | Anderson | 368/10 |
| 4,783,772 | 11/1988 | Umemoto et al. | 368/11 |
| 5,357,488 | 10/1994 | Udo et al. | 368/11 |

*Primary Examiner*—Bernard Roskoski

*Attorney, Agent, or Firm*—Dennison, Meserole, Pollack & Scheiner

[57] ABSTRACT

A sensor housing pipe is secured to a back of a watch at a recess formed on an underside of the back. A sensor is housed in the sensor housing pipe. A sensor lid is provided for securing the sensor in the sensor housing pipe. The sensor lid has openings for communicating the sensor with the outside of the watch.

2 Claims, 12 Drawing Sheets

WATCH HAVING A SENSOR

BACKGROUND OF THE INVENTION

The present invention relates to a watch having a sensor for sensing an environmental condition such as hydraulic pressure and atmospheric temperature.

In a conventional watch having a sensor, the sensor is mounted on a watch case or on a shield for shielding a dial, so that the sensor is projected from the surface of the shield or the watch case. There is a case that the projected sensor deteriorates the appearance of the watch.

Japanese Patent Application laid-Open 56-19480 discloses a watch having a sensor wherein the sensor is mounted on a back of the watch, so that the sensor is not exposed when worn on a wrist. In such a watch, there may occur a problem that a detecting portion of the sensor is blocked by a surface of a wet suit or skin of the wrist to prevent water from flowing to the sensor, rendering the detection of hydraulic pressure impossible.

SUMMARY OF THE INVENTION

An object of the present invention is to provide a watch having a sensor having simple construction wherein flow of water or air is not blocked, thereby ensuring the detection of hydraulic pressure, atomic pressure, and others.

According to the present invention, there is provided a watch having a watch case and a back, comprising a sensor housing pipe provided in a recess formed on an underside of the back, a sensor housed in the sensor housing pipe, a securing member for securing the sensor in the sensor housing pipe, at least one of the sensor housing pipe and the securing member having openings for communicating the sensor with outside of the watch.

In an aspect of the invention, the sensor housing pipe is integral with the back. Positioning means is provided for positioning the sensor with respect to a component member of the watch. The back is secured to the watch case by a screw ring. Sealing means is provided for keeping a screw thread of the screw ring watertight.

These and other objects and features of the present invention will become more apparent from the following detailed description with reference to the accompanying drawings.

BRIEF DESCRIPTION OF DRAWINGS

FIG. 5 is a sectional side view showing a fifth embodiment of the present invention.

DETAILED DESCRIPTION OF THE PREFERRED EMBODIMENTS

Figure 1:
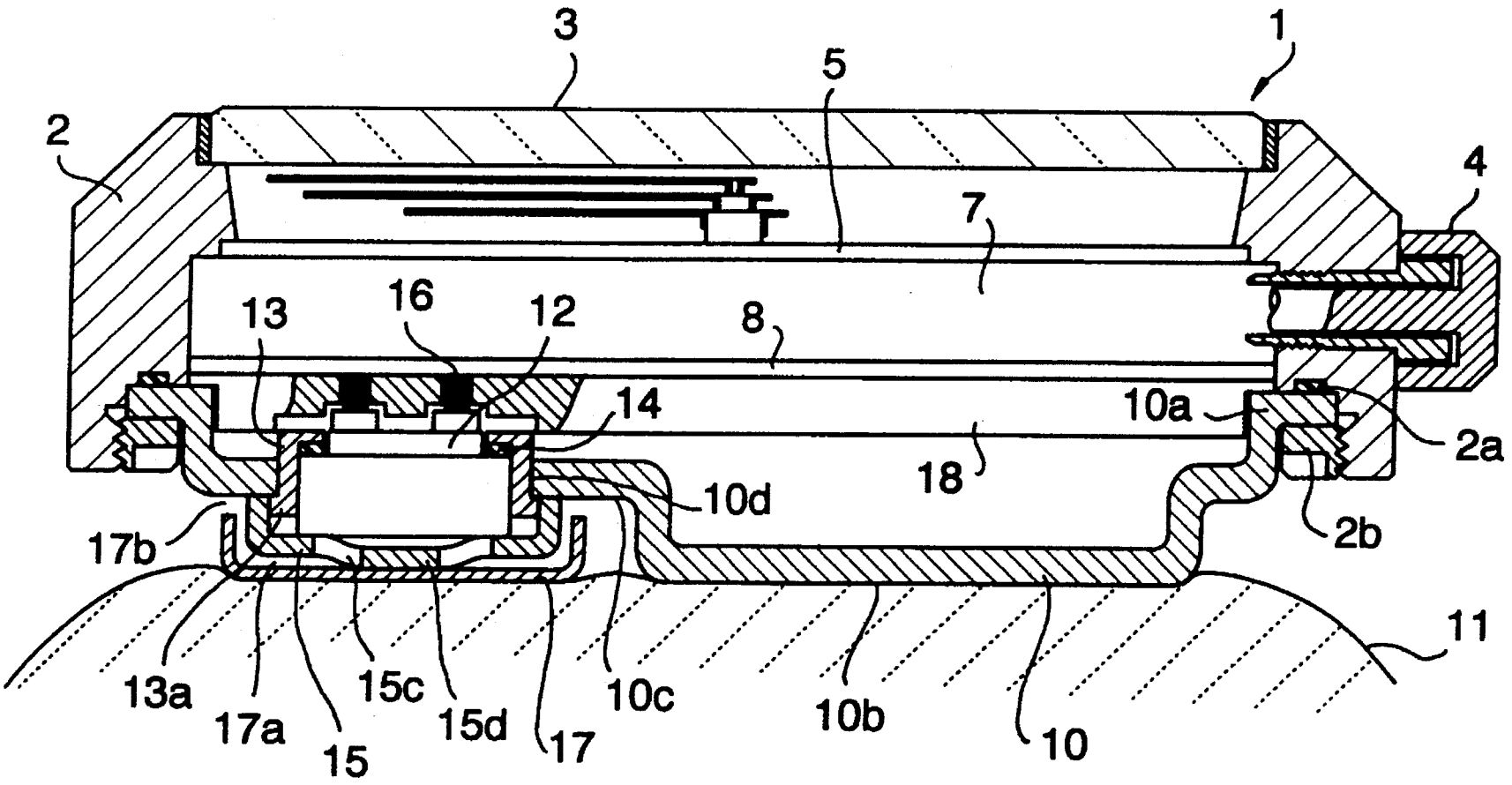
FIG. 1 is a sectional side view of an electronic wrist watch having a pressure sensor as a first embodiment of the present invention.

Referring to FIG. 1 showing the first embodiment of the present invention, an electronic wrist watch 1 has a watch case 2, a shield 3 secured to an upper edge of the watch case 2 and a crown 4 extending from a side of the watch case 2. In the watch case, a movement 7 having a dial 5 and a circuit board 8 are mounted.

Figure 2:
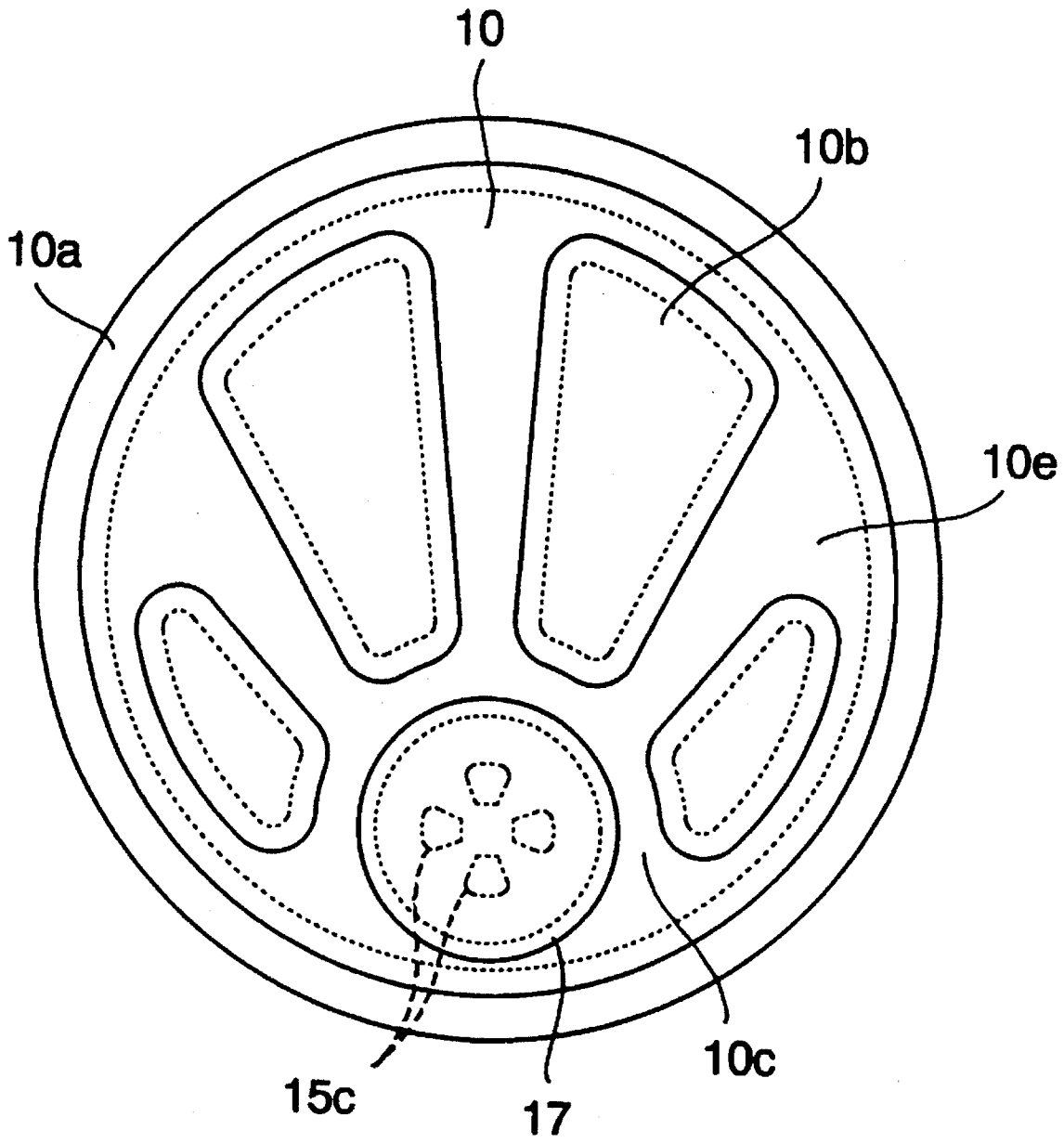
FIG. 2 is a plan view of a back of the watch of FIG. 1 as viewed from the outside thereof.

A back 10 is detachably secured to the watch case 2 at a flange 10*a* by a screw ring 2*b*, interposing an O-ring 2*a*. As shown in FIG. 2, the back 10 has a recess 10*c* for mounting a pressure sensor 12. From the recess 10*c*, a plurality of grooves 10*e* extend redially, thereby forming lands 10*b* between the grooves. Formed in the recess 10*c* is a hole 10*d* in which a sensor housing pipe 13 is inserted and secured to the back by brazing. The pressure sensor 12 is inserted in the sensor housing pipe 13, interposing an O-ring 14. The detecting portion of the sensor 12 is outwardly faced, and projected from a large diameter portion 13*a* of the housing pipe 13. A sensor lid 15 is secured to the large diameter portion 13*a* by press fitting, so that the pressure sensor 12 is secured in the housing pipe 13.

The sensor 12 is electrically connected to the circuit board 8 by connecting springs 16 each of which passes through a hole formed in a circuit supporting plate 18.

The sensor lid 15 has four openings 15*c* as shown in FIG. 2 so as to apply an outside pressure to the pressure sensor 12. Furthermore, a sensor cover 17 is secured to a projected portion 15*d* of the sensor lid 15 by welding. The sensor cover 17 has a shape for covering the whole of the sensor lid 15. However, a gap 17*a* is formed between the sensor cover 17 and the sensor lid 15 except for the projected portion 15*d*. A gap 17*b* is formed between the end of the sensor cover 17 and the back 10. The sensor cover 17 is provided such that the underside of the cover 17 becomes coplanar with the surface of the land 10*b* of the back. Thus, the underside of the watch contacts with a wrist 11 of the wearer without rough feeling when worn.

In use in water, the water enters the sensor cover 17 passing through the grooves 10*e*, recess 10*c* of the back 10 and the gap 17*b* between the cover 17 and the back 10. The water flows in the sensor lid 15 passing through the gaps 17*b* and 17*a*, and the openings 15*c*. Thus, the water pressure is applied to the pressure sensor 12. Therefore, the water pressure can be reliably measured without blocking of the wet suit or the skin of the wrist.

In use in atmosphere, the atmospheric pressure is exactly applied to the pressure sensor 12 in the same manner as the detection of the water pressure.

Figure 3:
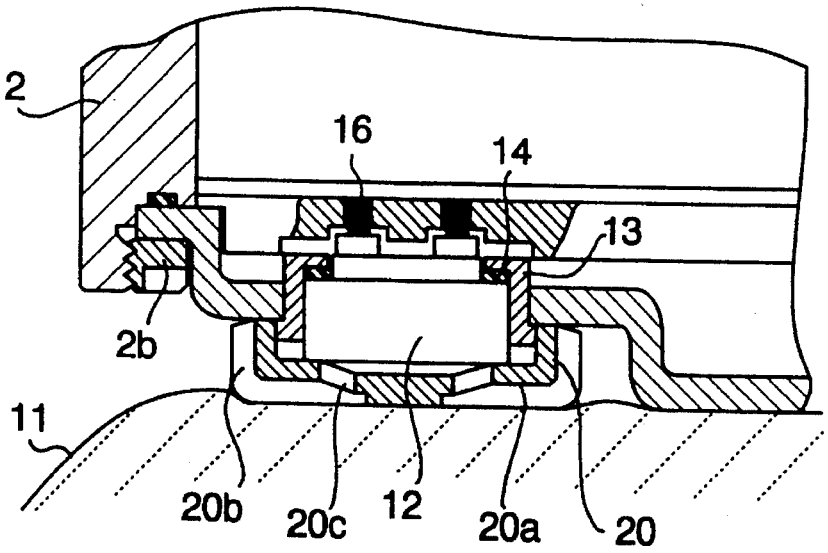
FIG. 3 is a sectional side view of a sensor mounting portion in a second embodiment of the present invention.
Figure 4:
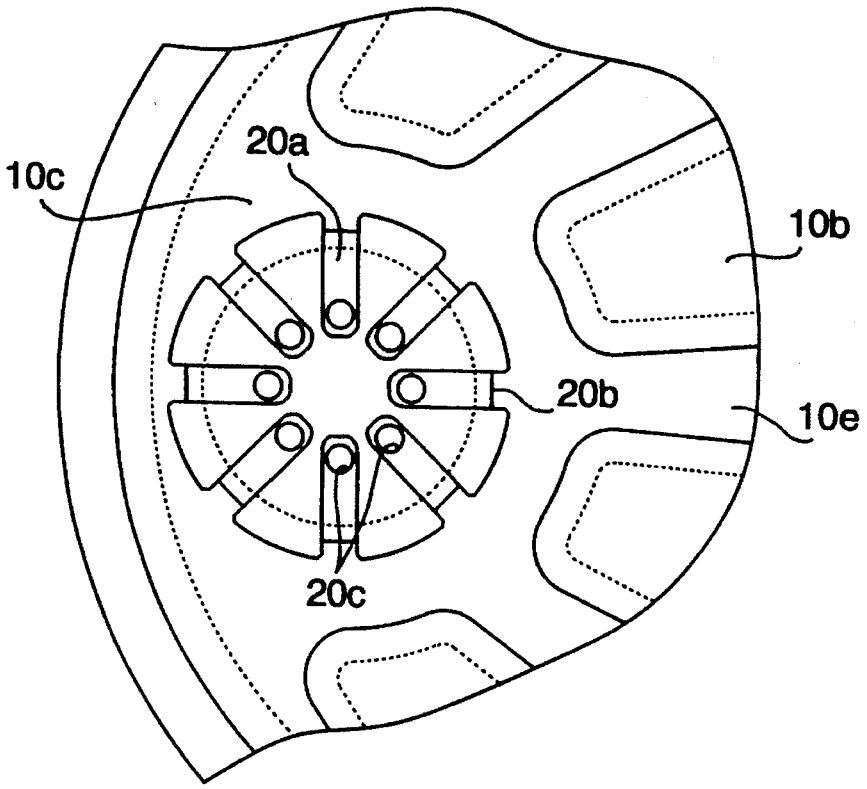
FIG. 4 is a plan view of a back of the watch of FIG. 3 as viewed from the outside thereof.

Referring to FIGS. 3 and 4 showing the second embodiment of the present invention, the same parts as FIGS. 1 and 2 are identified with the same reference numerals as those of the figures. In the second embodiment, the sensor cover 17 of the first embodiment is not provided, and hence a sensor lid 20 is directly contacted with the wrist 11. The sensor lid 20 is secured to the housing pipe 13 by the press fit. The sensor lid 20 has radially arranged grooves 20*a* on the peripheral wall and grooves 20*b* on the underside wall, each communicated with the groove 20*a*. An opening 20*c* is formed in an inner end of each groove 20*a*.

Outside pressure is applied to the pressure sensor 12 through the grooves 20*a* and 20*b* and openings 20*c*. Since the grooves 20*a* are radially arranged and communicated with the peripheral grooves 20*b*, the grooves are not blocked by the skin of the wrist.

Figure 5:
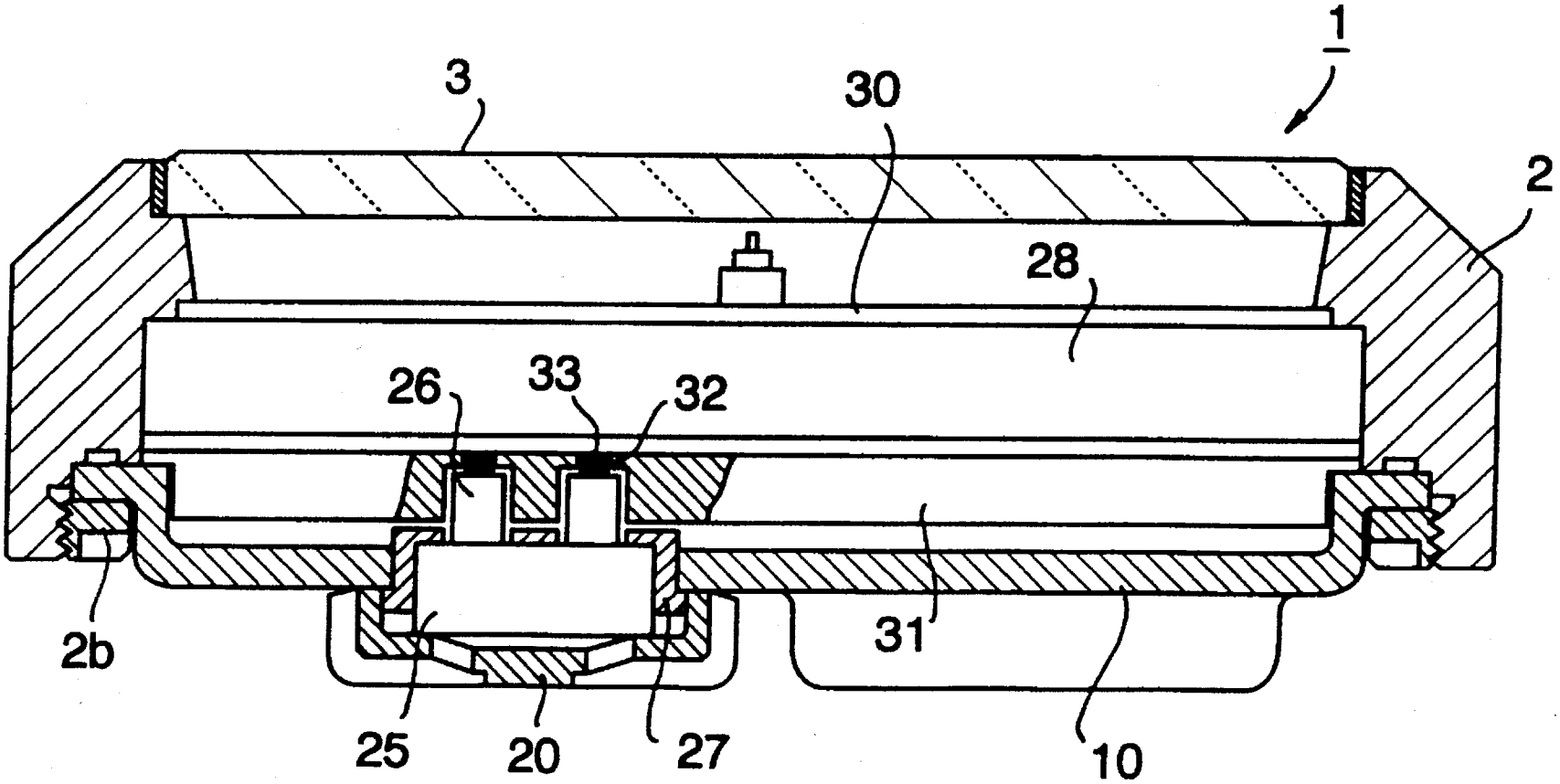
FIG. 5 is a sectional side view showing a third embodiment of the present invention.

Referring to FIG. 5 showing the third embodiment, a pressure sensor 25 has two sensor pins 26 on the underside thereof. The pins 26 extend from holes of a housing pipe 27. A movement 28 comprises an electronic circuit block 30 and a circuit supporting plate 31.

The pressure sensor 25 is inserted in the housing pipe 27 secured to the back 10 and fixed by the sensor lid 20. The movement 28 is mounted in the watch case 2, and connecting springs 33 are inserted in holes 32 of the circuit supporting plate 31. Each of the sensor pins 26 is engaged with the hole 32, and the back 10 is secured to the watch case 2 by the screw ring 2*b*.

Figure 6:
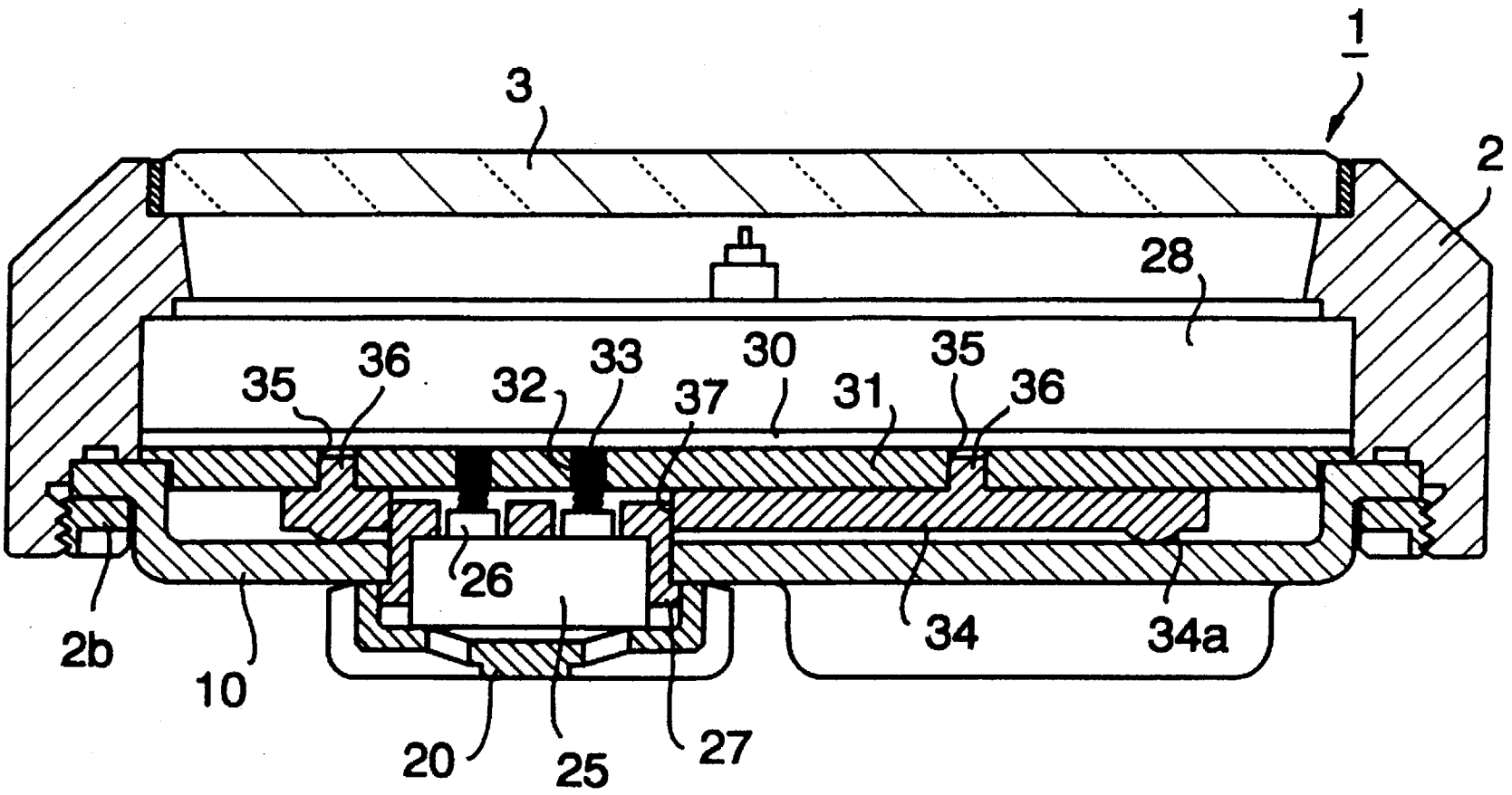
FIG. 6 is a sectional side view showing a fourth embodiment of the present invention.

FIG. 6 shows the fourth embodiment of the present invention. In the watch, an intermediate member 34 is disposed between the circuit supporting plate 31 and the back 10. The intermediate member 34 has two pins 36 to be engaged with positioning holes 35 of the circuit supporting plate 31, respectively. A hole 37 is formed in the intermediate member 34 for receiving the housing pipe 27.

The movement 28 is inserted in the watch case 2, connecting springs 33 are inserted in the holes 32 of the circuit supporting plate 31, and the pins 36 are engaged with the positioning holes 35, respectively. The housing pipe 27 secured to the back 10 is engaged in the hole 37 of the intermediate member 34, and the back 10 is fixed to the watch case 2 by the screw ring 2*b*. Thus, the back 10 engages with semispheric projections 34*a*, thereby holding the intermediate member 34.

In accordance with the third and fourth embodiments, positioning means is provided for positioning the pressure sensor and the electronic circuit block. Therefore, both the members can be easily and exactly connected with each other.

Figure 7:
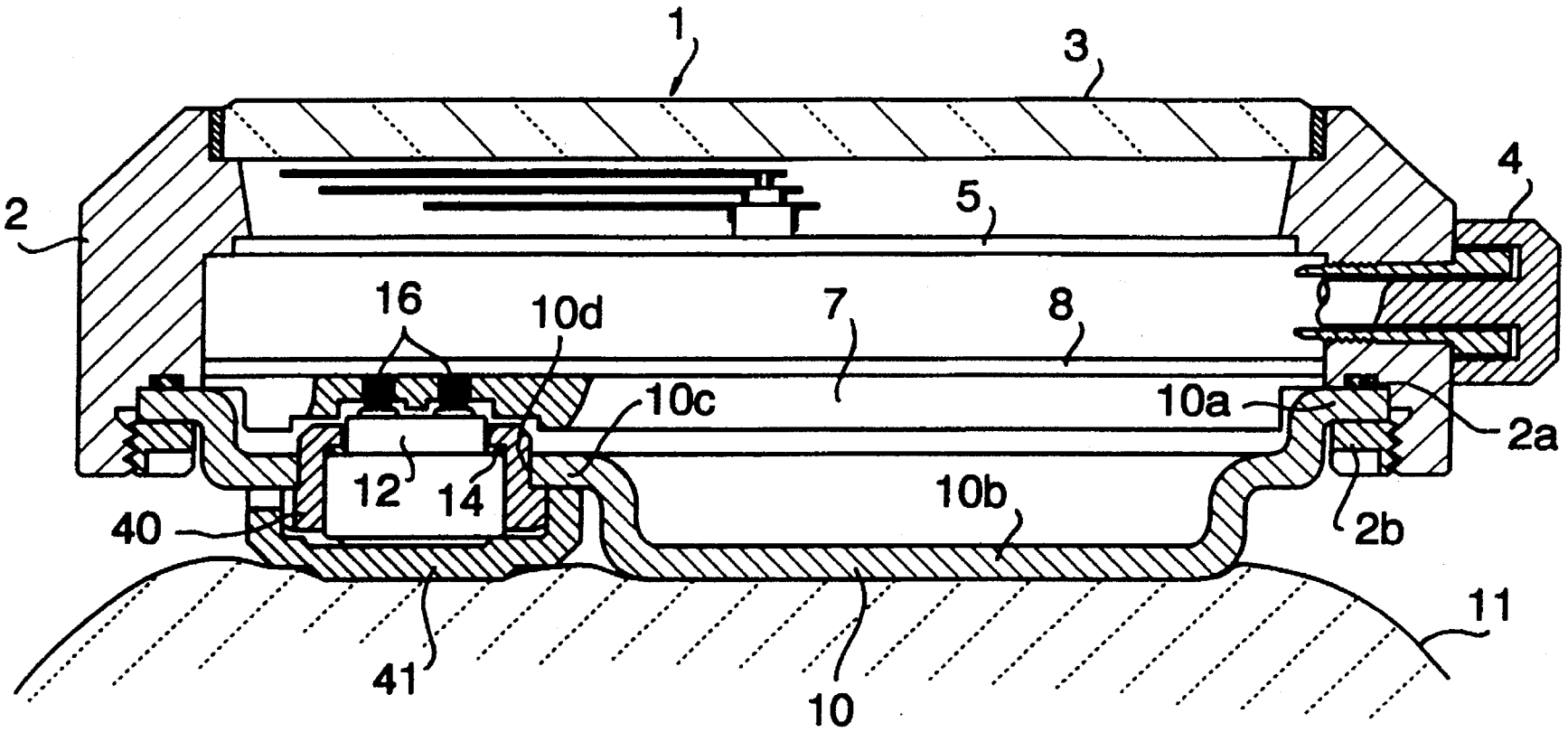
Figure 8:
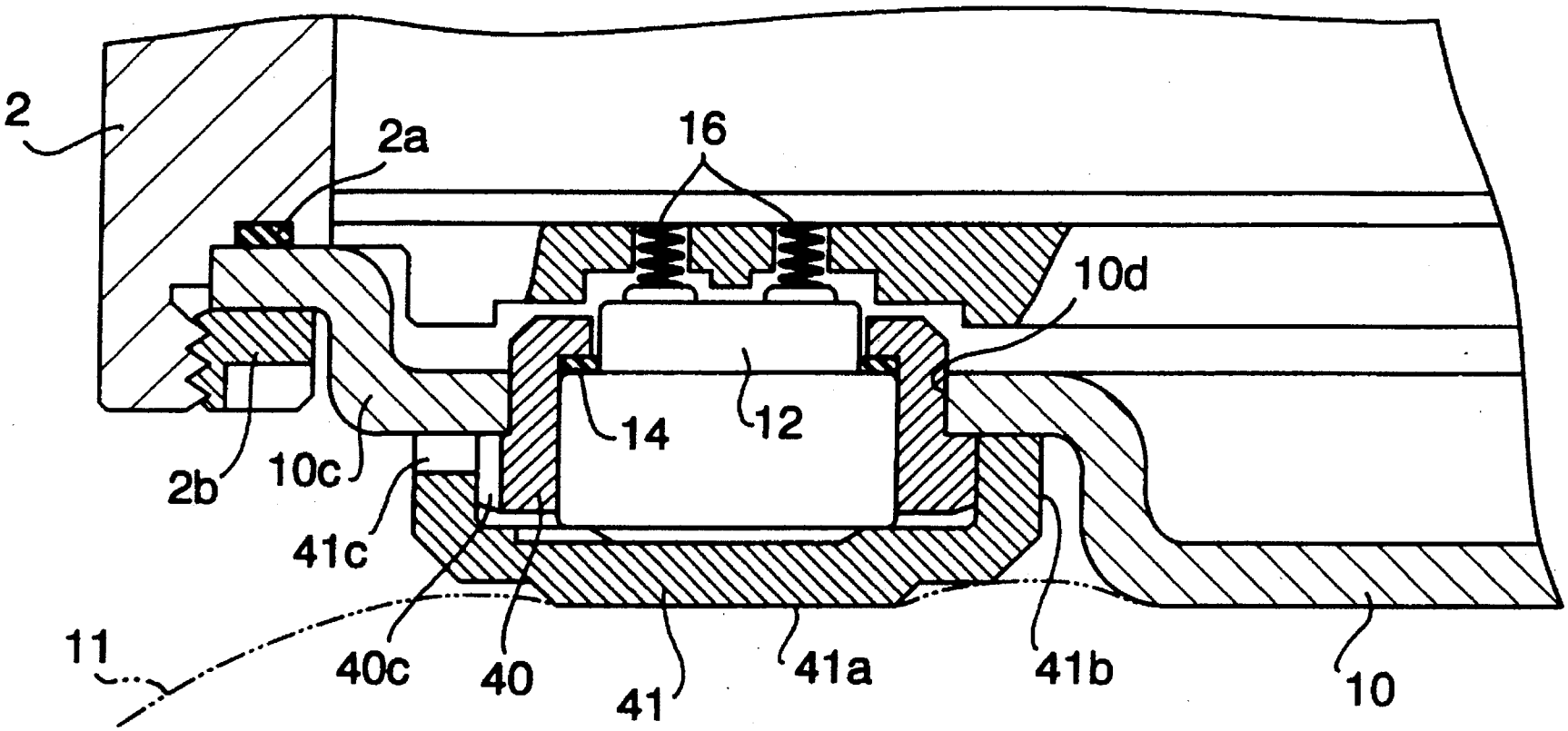
FIG. 8 is an enlarged sectional view of a part of FIG. 7.

Referring to FIGS. 7 and 8 showing the fifth embodiment, the watch is characterized by a housing pipe 40 and a sensor lid 41, the other structure is the same as the second embodiment.

Figure 9:
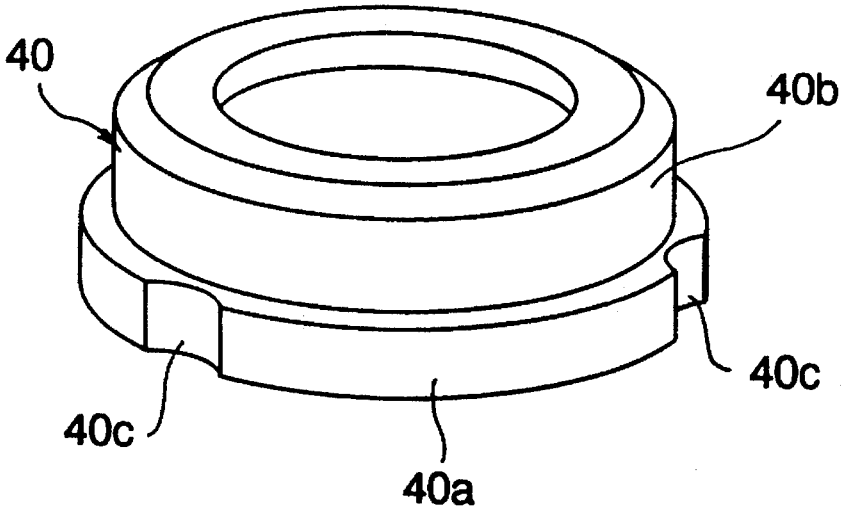
FIG. 9 is a perspective view showing a housing pipe of FIG. 7.

As shown in FIG. 9, the housing pipe 40 comprises a large diameter portion 40*a* and a small diameter portion 40*b*. Three grooves 40*c* are formed on the large diameter portion 40*a*. The small diameter portion 40*b* is engaged with the hole 10*d* of the back 10 and secured thereto by brazing.

Figure 10:
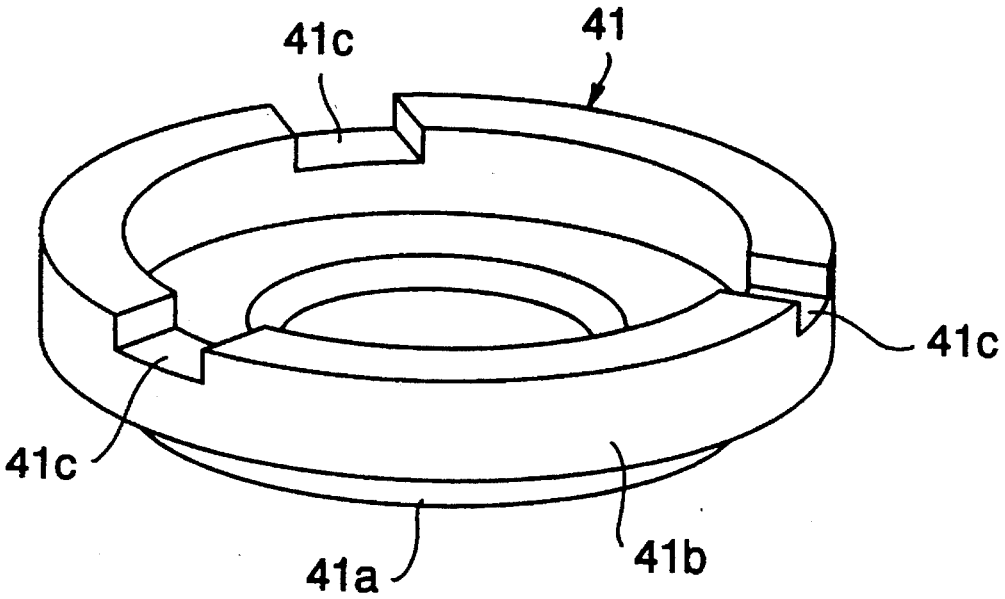
FIG. 10 is a perspective view showing a sensor lid thereof.

As shown in FIG. 10, the sensor lid 41 comprises a base portion 41*a* and an annular peripheral portion 41*b*. A plurality of grooves 41*c* are formed on the peripheral portion 41*b*, corresponding to grooves 40*c* of the housing pipe 40.

The sensor lid 41 is secured to the housing pipe 40 by press fit at a position where the grooves 41*c* correspond to the groves 40*c*.

In use, water enters the space between the pressure detecting portion of the pressure sensor 12 and the sensor lid 41 passing through grooves 41*c* and 40*c*, so that water pressure can be accurately measured.

Figure 11:
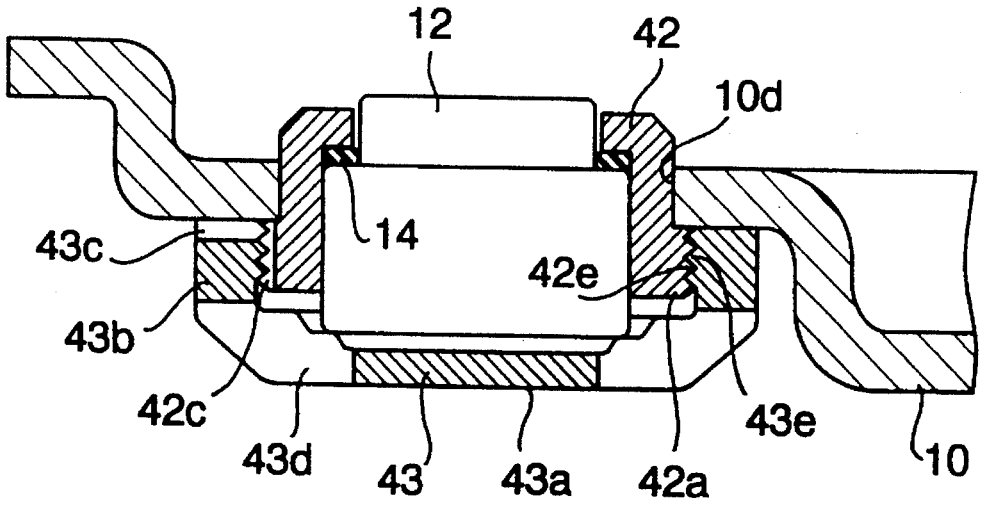
FIG. 11 is a sectional side view showing a sixth embodiment of the present invention.

FIG. 11 shows the sixth embodiment of the present invention. A housing pipe 42 has a screw thread 42*e* formed on a large diameter portion 42*a* and grooves 42*c*. A sensor lid 43 has a plurality of openings 43*d* at a base portion 43*a* and an annular portion 43*b*, a plurality of radial grooves 43*c* formed on the peripheral end thereof, and a screw thread 43*e* formed on the inside wall. Each of the openings 43*d* is opened facing outwardly.

The sensor lid 43 is secured to the housing pipe 42 by engagement of screw threads 42*e* and 43*e*.

In accordance with the embodiment, the openings 43*d* are provided in addition to grooves 42*c* and 43*c*. Thus, pressure can be more accurately measured.

Figure 12:
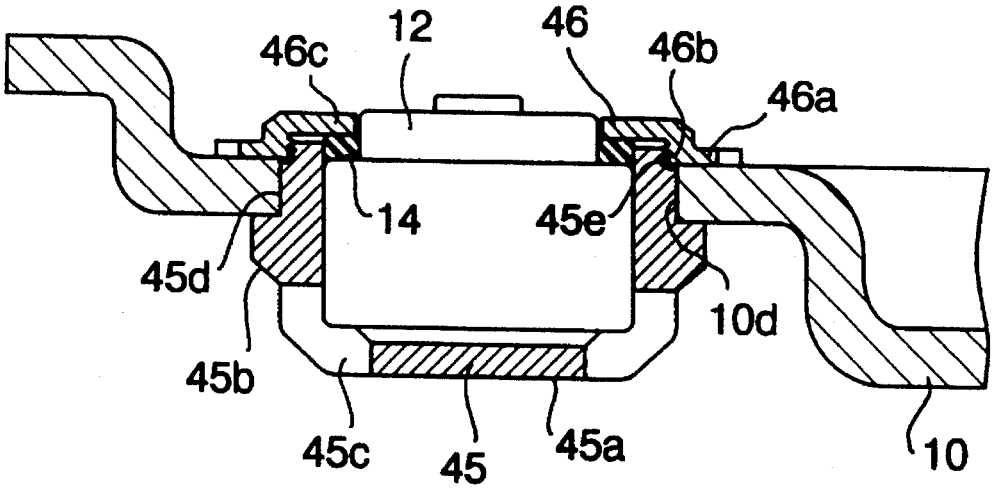
FIG. 12 is a sectional side view showing a seventh embodiment of the present invention.

Referring to FIG. 12 showing the seventh embodiment, a housing pipe 45 has an annular portion 45*b*, a plurality of openings 45*c* at a base portion 45*a* and the annular portion 45*b*, an annular shoulder portion 45*d* and a screw thread 45*e* formed on an upper peripheral wall. A screw ring 46 is provided for securing the pressure sensor 12 in the housing pipe 45. The screw ring 46 comprises an annular portion 46*a*, a screw thread 46*b* to be engaged with the screw thread 45*e* of the housing pipe 45, and a flange 46*c*.

The screw thread 45*e* of the housing pipe 45 projects from the inside wall of the back 10. The O-ring 14 is disposed between the pressure sensor 12 and the flange 46*c*. The screw thread 46*b* is engaged with the screw thread 45*e*, thereby securing the pressure sensor 12 in the housing pipe 45.

Figure 13:
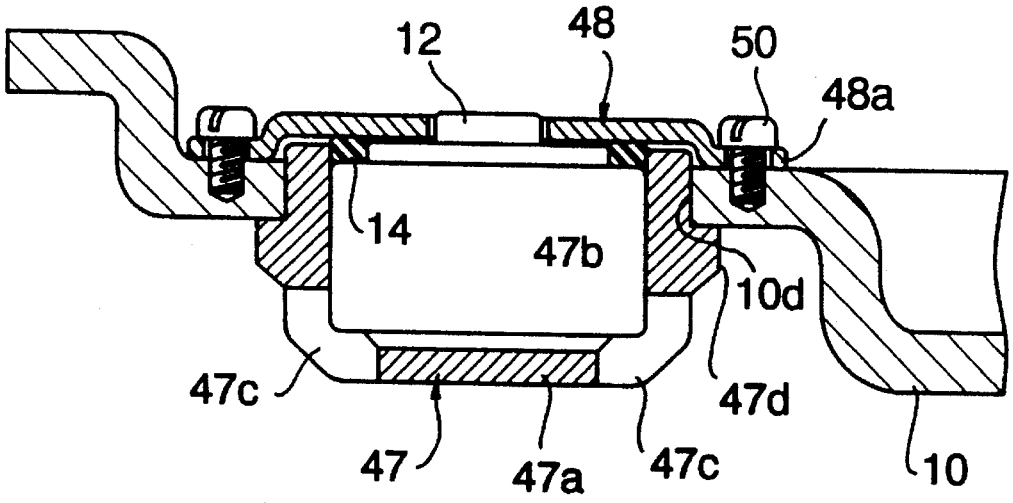
FIG. 13 is a sectional side view showing an eighth embodiment of the present invention.

FIG. 13 shows the eighth embodiment. A housing pipe 47 comprises a base portion 47*a* having a plurality of openings 47*c*, and an annular portion 47*b* secured to the back 10 by brazing. A flange 47*d* is formed on the annular portion 47*b*, abutted on the underside of the back 10.

Figure 14:
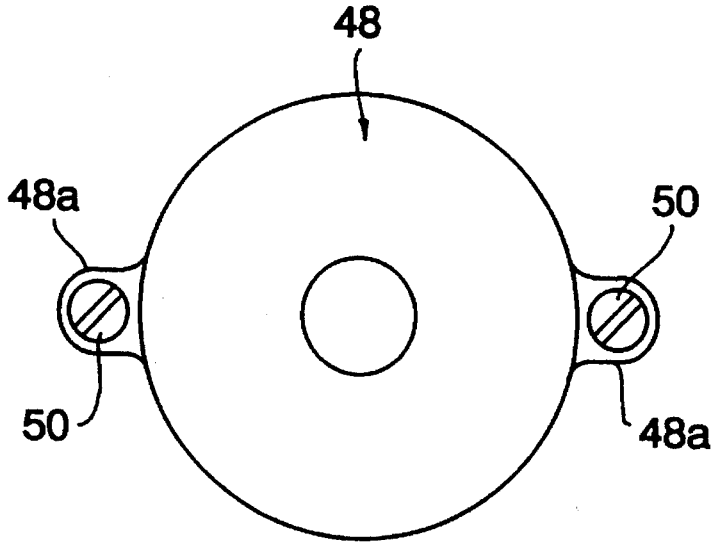
FIG. 14 is a plan view showing a holding plate of FIG. 13.

The pressure sensor 12 is inserted in the housing pipe 47. The inner end of the housing pipe 47 is projected from the inside wall of the back. The O-ring 14 is disposed on the inside wall of the housing pipe 47, and a holding plate 48 is mounted on the O-ring 14. The holding plate 48 has a pair of lugs 48*a* each having a hole for a screw 50, as shown in FIG. 14. The holding plate 48 is secured to the back 10 by the screws 50. Thus, the pressure sensor 12 is held in the housing pipe 47.

Figure 15:
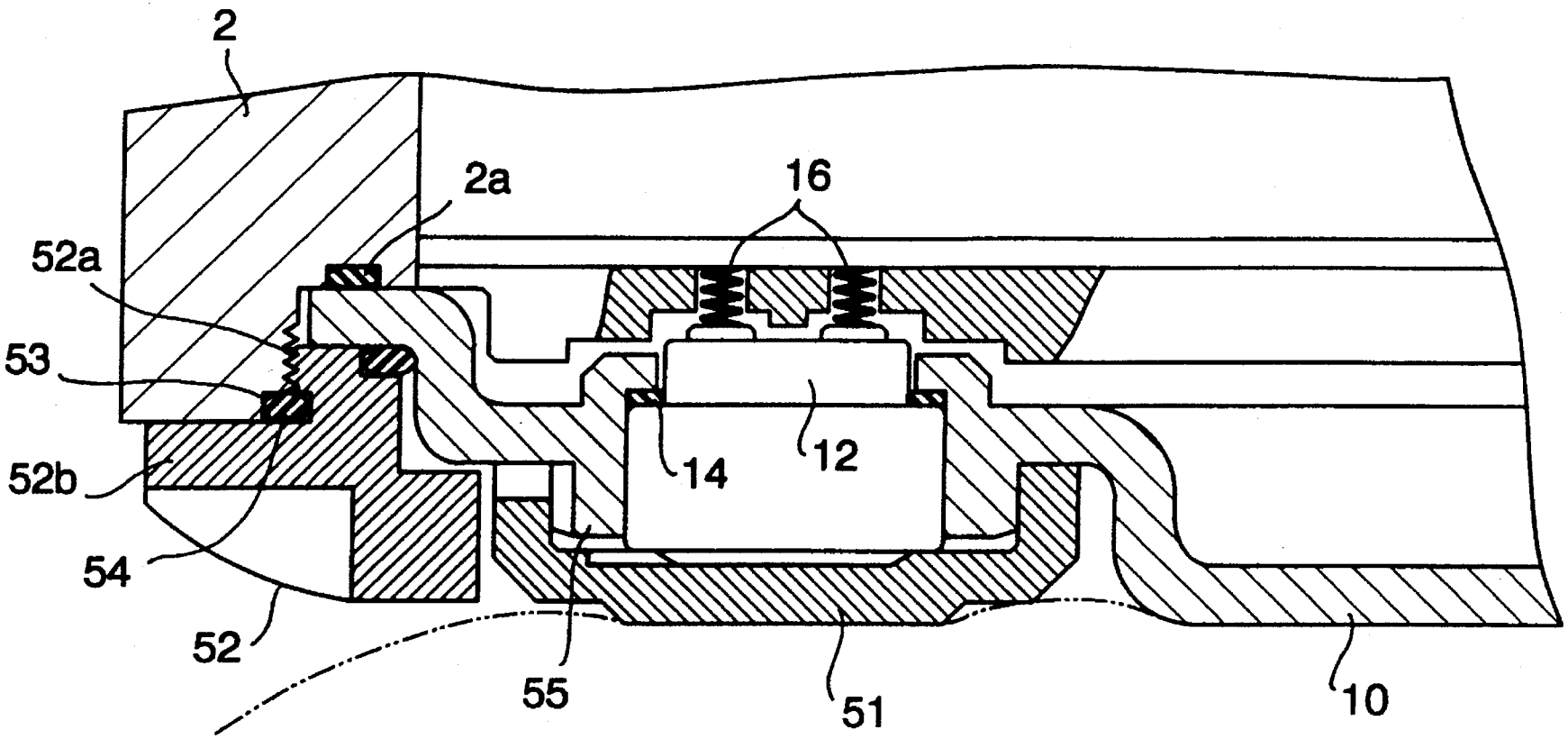
FIG. 15 is a sectional side view showing a ninth embodiment of the present invention.

Referring to FIG. 15 showing the ninth embodiment of the present invention, the embodiment is characterized in that a housing pipe is integral with the back and the screw thread of the screw ring for securing the back is kept watertight.

Figure 16:
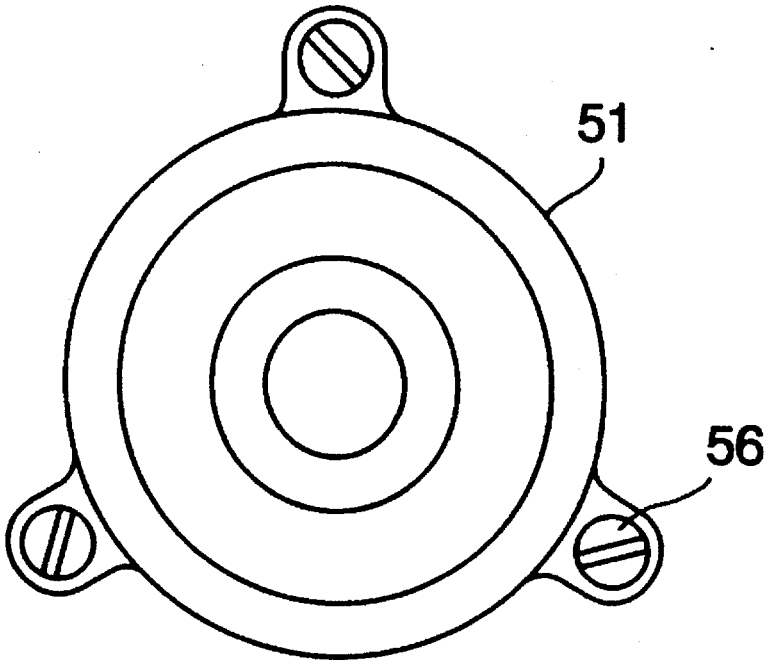
FIG. 16 is a plan view showing a sensor lid of FIG. 15 as viewed from the outside thereof.

Namely, a housing pipe 55 having the same shape as the housing pipe 40 of FIG. 8 is integral with the back 10. As shown in FIG. 16, a sensor lid 51 has three lugs, each having a hole for a screw 56. The pressure sensor 12 is inserted in the housing pipe 55 interposing the O-ring 14. The sensor lid 51 is secured to the back 10 by the screws 56. Thus, the sensor is held in the housing pipe 55.

On the other hand, a screw ring 52 has an outwardly extending flange 52*b* at a position below a screw thread 52*a*. An annular groove 53 is formed on the underside of the watch case 2 below the screw thread 52*a*. In the groove 53, an O-ring 54 is engaged. Thus, by engaging the screw ring 52 with the watch case 2, screw threads of the watch case 2 and the screw ring 52 are kept watertight. Therefore, the screw threads 52*a* are prevented from rusting.

In accordance with the embodiment, since the housing pipe is integral with the back, the construction of the watch is simplified. Screw threads of the watch case and the screw ring for securing the back to the watch case is kept water-tight. Consequently, the rusting of the screw threads which renders the screw ring undetachable can be prevented.

While the invention has been described in conjunction with preferred specific embodiment thereof, it will be understood that this description is intended to illustrate and not limit the scope of the invention, which is defined by the following claims.

What is claimed is:

1. A wrist watch having a watch case and a back, comprising:

a sensor housing pipe provided in a recess formed on an underside of the back;

a sensor housed in the sensor housing pipe;

securing means for securing the sensor in the sensor housing pipe;

the back having a plurality of grooves formed on the underside thereof and communicating the recess on the back with outside of the watch;

an outermost member mounted on said back and having an underside, an engaging surface formed on the underside of the outermost member and being flush with the underside of the back to engage with a wrist of a wearer;

the outermost member having an opening at a position inward of the engaging surface, opening to an outside of watch, and communicating with said groove; and a fluid passage provided within the outermost member and communicating the sensor with the opening to sense an environmental condition of the watch, said outermost member being a sensor lid secured to the sensor housing pipe.

2. A wrist watch having a watch case and a back, comprising:

a sensor housing pipe provided in a recess formed on an underside of the back;

a sensor housed in the sensor housing securing means for securing the sensor in the sensor housing pipe;

the back having a plurality of grooves formed on underside thereof and communicating the recess on the back with outside of the watch;

an outermost member mounted on said back and having an underside, an engaging surface formed on the underside of the outermost member and being flush with the underside of the back to engage with a wrist of a wearer;

the outermost member having an opening at a position inward of the engaging surface opening to an outside of the watch, and communicating with said grooves;

a fluid passage provided within the outermost member and communicating the sensor with the opening to sense an environmental condition of the watch; and a sensor lid secured to the sensor housing pipe, said outermost member being a sensor cover secured to the sensor lid.

* * * * *

UNITED STATES PATENT AND TRADEMARK OFFICE

CERTIFICATE OF CORRECTION

PATENT NO. : 5,592,442

DATED : January 7, 1997

INVENTOR(S) : Junichi NISHIKAWA; Tomomi MURAKAMI; Nobuyuki UEHARA

It is certified that error appears in the above-indentified patent and that said Letters Patent is hereby corrected as shown below:

Column 5, line 31, before "watch" insert --the--.

Column 6, line 10, after "housing" insert --pipe;--.

Column 6, line 13, after "on" insert --the--.

Signed and Sealed this

Eleventh Day of March, 1997

*Attest:*

BRUCE LEHMAN

*Attesting Officer*

*Commissioner of Patents and Trademarks*